US006021585A

United States Patent [19]

Cole

[11] Patent Number: 6,021,585

[45] Date of Patent: Feb. 8, 2000

[54] FOOTWEAR

[75] Inventor: David Cole, Thousand Oaks, Calif.

[73] Assignee: IF360°, LLC, Thousand Oaks, Calif.

[21] Appl. No.: 09/216,822

[22] Filed: Dec. 21, 1998

Related U.S. Application Data

[60] Provisional application No. 60/091,106, Jun. 29, 1998.

[51] Int. Cl.[7] ..... A43B 3/12

[52] U.S. Cl. ..... 36/11.5; D2/903

[58] Field of Search ..... 36/105, 11.5, 50.1; D2/903, 929

[56] References Cited

U.S. PATENT DOCUMENTS

| | | | |
|---|---|---|---|
| 1,088,309 | 2/1914 | Weidt . | |
| 2,112,884 | 4/1938 | Gillette et al. | 36/11.5 |
| 2,126,094 | 8/1938 | Daniels | 36/11.5 |
| 2,259,273 | 10/1941 | Smith | 36/11.5 |
| 2,451,372 | 10/1948 | Ballenger | 36/11.5 |
| 2,526,940 | 10/1950 | Fello | 36/11.5 |
| 2,590,648 | 3/1952 | Pitz | 36/11.5 |
| 2,642,677 | 6/1953 | Yates | 36/11.5 |
| 2,669,036 | 2/1954 | Israel | 36/11.5 |
| 3,070,908 | 1/1963 | Lipare | 36/11.5 |
| 3,121,962 | 2/1964 | Gullo | 36/11.5 |
| 3,275,002 | 9/1966 | Scholl | 128/581 |
| 3,352,033 | 11/1967 | Colley | 36/11.5 |
| 3,455,037 | 7/1969 | Vlas et al. | 36/11.5 |
| 3,925,914 | 12/1975 | Marcoux | 36/11.5 |
| 4,200,997 | 5/1980 | Scheinhaus et al. | 36/11.5 |
| 4,446,633 | 5/1984 | Scheinhaus et al. | 36/11.5 |
| 4,679,334 | 7/1987 | McBride | 36/114 |
| 4,793,075 | 12/1988 | Thatcher | 36/11.5 |
| 4,869,000 | 9/1989 | York, Jr. | 36/11.5 |
| 5,056,241 | 10/1991 | Young | 36/11.5 |
| 5,561,919 | 10/1996 | Gill | 36/11.5 |

*Primary Examiner*—B. Dayoan
*Attorney, Agent, or Firm*—Sheldon & Mak

[57] ABSTRACT

A slippage-resistant sandal includes a sole, a heel strap, and a main strap. The heel strap is non-adjustably and fixedly secured to the sole. It extends rearwardly to form a loop for engaging the wearer's heel. One end of the main strap is secured to the forward portion of the sole. The other end is adjustably and releasably secured with securing means to accommodate different size and shape feet. The main strap extends through a channel in the sole to form a forward loop for engaging a forward portion of a wearer's foot and an ankle loop for engaging the wearer's ankle. The ankle loop is interconnected to the heel strap.

9 Claims, 6 Drawing Sheets

FOOTWEAR

CROSS-REFERENCE

This application claims priority from Provisional Patent Application Ser. No. 60/091,106 filed Jun. 29, 1998, entitled "INFINITE FIT 360 SANDAL," which is incorporated herein by reference.

BACKGROUND

This invention relates to footwear, specifically to an improved fit system applicable to sandalized footwear. The history of such footwear can be traced in prior art patents which are listed in the information disclosure statement provided with this application.

These patents reveal that sandalized footwear has historically served more as foot adornment than as secure-fitting footwear. Until the late 1980's, some of the rare exceptions were very orthopedic and encumbered with multiple buckle closures which offered only incremental fit adjustments to the nearest one-third inch.

Significant progress was made in sandal fit in the 1980's, utilizing continuous straps that passed through the sole and featured singular hook and loop closures. Unfortunately, these constructions allowed some dislocation of the foot under conditions of challenging terrain, particularly in walking in extreme uphill conditions, and lacked easy adaptability to use with socks, as is occasionally appropriate to the intended wearer in certain kinds of terrain and under some weather conditions.

The 1990's have seen an abundance of rugged outdoor sandals, featuring various upper configurations in combination with multiple hook and loop closures. Although multiple hook and loop closures offer adjustability, resistance to forward slippage and general wearer comfort are limited with these closures.

Accordingly, there exists a need for comfortable, continuously adjustable footwear, and particularly a sandal, with an improved fit dynamic, which provides substantial resistance to both forward and rearward foot slippage, which can be worn with socks, and whose upper consistently tracks flatly on all contours of the foot.

SUMMARY

The present invention provides footwear that satisfies this need. The footwear is provided with a sole having a rear heel portion, a forward toe portion and an intermediate portion therebetween. A unique and novel slippage resistant heel halter is provided. The heel halter comprises a heel strap that is non-adjustably and fixedly secured to the sole at the intermediate portion of the sole, and which extends rearwardly to form a loop for engaging the heel of the footwear. An ankle strap is secured to the sole forward of the rear heel portion, the ankle strap forming an ankle loop for engaging the wearer's ankle. Means are provided for interconnecting the ankle strap to the heel strap where the heel strap engages the wearer's heel. Preferably the interconnecting means is a channel in the heel strap through which the ankle strap extends.

In a typical configuration, the ankle strap is a portion of a main strap that is also used to hold the forward portion of the wearer's foot. The main strap has a first portion and second portion. The first portion is secured by first securing means to the sole and forms a forward loop for engaging the forward portion of the wearer's foot, extends through a first transverse channel in the forward portion of the sole, and extends rearwardly to form the ankle loop that engages the wearer's ankle. The second portion of the main strap is provided with securing means for adjustably and releasably securing the main strap to the sole to accommodate different sized and shaped feet.

Preferably, the securing means comprises a forward strap that is fixedly secured to the forward portion of the sole, and a fastener for adjustably and releasably fastening the main strap to the forward strap. Preferably the forward strap also includes a loop over the forward portion of the sole for engaging the forward portion of the wearer's foot, thus providing two loops for this purpose. A second transverse channel can be provided through the sole for the forward strap.

With this footwear design the preexisting need is satisfied, particularly due to the heel halter's construction which avoids rearward slippage when walking uphill. The footwear is very comfortable, can be adjustably tightened and can be comfortably worn with socks.

DRAWINGS

These and other features, aspects and advantages of the present invention will become better understood from the following description, appended claims, and accompanying drawings where:

DESCRIPTION

Figure 1:
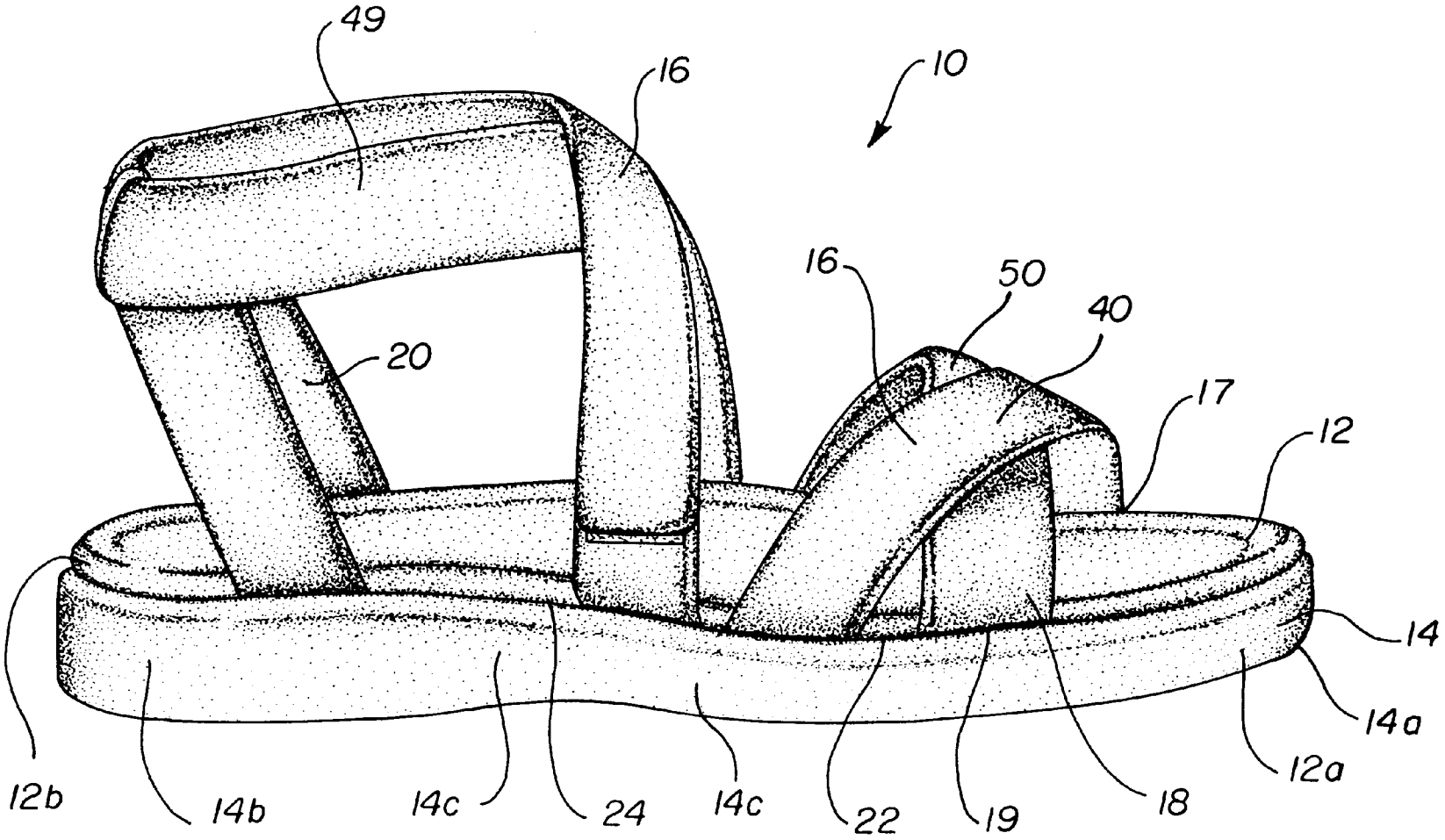
FIG. 1 is a perspective view of a sandal according to the present invention, the sandal having an insole and an outer sole.

FIGS. 1–8 illustrate a preferred embodiment of footwear and particularly a sandal 10, according to the present invention. The sandal 10 comprises an insole 12, which is supported by an outer sole 14. The insole 12/outside sole 14 combination anchors a long main strap 16, at a long strap anchor point 17, a short forward strap 18, at a short strap anchor point 19, and a heel strap 20. Both the insole 12 and the outer sole 14 have a forward section 12*a*, 14*a*, a rear heel portion 12*b*, 14*b*, and an intermediate portion 12*c*, 14*c*, respectively. A first transverse channel, i.e., a long strap channel 22, and a second transverse channel, i.e., a short strap channel 24*a*, 24*b*, which cross each other, are defined between the insole 12 and the outer sole 14.

As detailed below, indents formed into the inner side of the insole 12 accommodate the straps 1 6 and 1 8 at their anchoring points and also form the tops of the channels 22 and 24. Matching indents in the outer sole 14 form the bottoms of the channels 22 and 24.

The heel strap 20 defines a heel opening 30 adapted to accept and constrain a human heel. A pair of side strap portions 32 of the heel strap 20 are positioned to face and support the side surfaces of a human wearer's foot in the heel region. An upper, back strap portion 34 of the heel strap 20 is positioned to face the rear surface of the wearer's foot directly above the heel. As discussed below, preferably the heel strap 20 is constructed out of leather with a nylon reinforcement tape. This construction plus the shape of the heel strap 20, extending upwardly and rearwardly from the intermediate portion 12*c*, 14*c* of the sole, and rotating 180° at the top to define the upper, back strap portion 34 gives heel strap 20 some stiffness to hold and support the wearer's heel. The upper, back portion 34 defines a halter channel 36 that is shaped to accommodate the long main strap 16.

The long strap 16, starting at the anchor point 17, forms a long strap toe loop 40 about the wearer's toe region before extending through the long strap channel 22. After emerging from the long strap channel 22, the long strap 16 extends across the top of the wearer's foot in the forward portion 12*a*, 14*a* before curving about the wearer's ankle, extending through the halter channel 36 and again curving about the ankle to be fastened to the short strap 18. Thus, the long strap serves as an ankle strap forming an ankle loop 49, that in combination with the heel strap 20, provides a slippage-resistant heel halter.

The short strap 18, starting at its anchor point 19, forms a short strap toe loop 50 about the wearer's toe region before extending through the short strap channel 24. Only a short connection portion 52 emerges from the short strap channel 24 to be attached to the long strap 16 with a closure 53.

The closure 53 is preferably a hook and loop type fastener, commonly sold under i:he trademark Velcro, where the hook portion is provided on the short strap 18 or the long strap 16, and the loop portion is provided on the other strap. However, other conventional closures can be used, such as a non-incremental buckle-type fastener of metal or plastic (of the type used to adjust suspenders), a non-incremental twin loop fastener of metal or plastic (of the type used to secure a life vest), or a lace to be tied.

Figure 7:
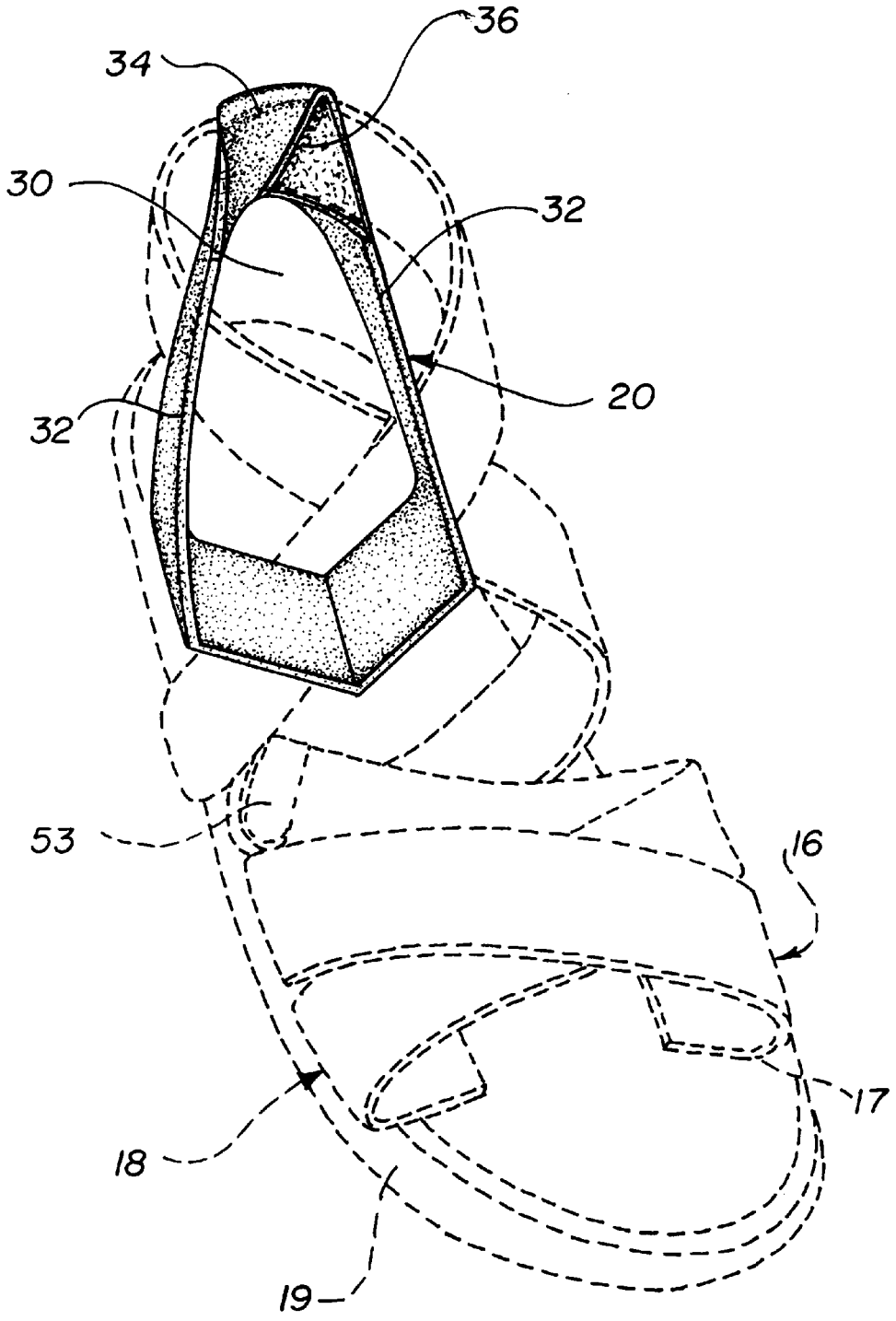
FIG. 7 is an isometric view of the heel halter of the sandal of FIG. 1.

As best shown in FIG. 7, the ankle strap 20 is a continuous strap extending under the insole 12 where it is held firmly in place. Alternatively, the ankle strap 20 can be fixed to sole anchoring points at the edge of the sole, just as the long strap 16 and short strap 18 are fixed to the sole.

Preferably, the straps 16, 18, and 20 are made from a leather strip simply folded to form an internal closure creating a seam 64 (FIGS. 5 and 6) around a typical nylon reinforcement tape, and is accordingly unlined. The straps 16, 18, and 20 can also be made in a variety of other ways in leather, such as:

1. precombining leather back-to-back and cutting with raw edges;
2. cutting leather of sufficient thickness so these straps can be made unlined with raw edges;
3. skiving leather at the edges, folding to a minimal folding allowance and subsequently stitching to a leather or non-leather lining; or
4. using leather which is braided, woven, interlaced, or embossed and utilized in any combination of the methods described above.

Leather, for the purposes of this specification, should be understood to be a commodity article originating in the hides of commercial or exotic livestock, irrespective of its tannage and finishing, which would be classifiable as leather under the categories applicable to footwear of the international Harmonized Trade System (HTS) and/or sub-classes of U.S. Customs' T.S.U.S. schedules.

Additionally, there are a great variety of non-leather components that can be used to form the straps 16, 18, and 20, most of which would employ methods of manufacture similar to those described above for leather or variations thereof, including:

1. man-made imitation leathers such as polyurethane and polyvinylchloride;
2. woven and/or non-woven textile products of natural or man-made fibers;
3. latex rubbers, thermoplastic rubbers, ethylvinylacetates, and flexible plastics used individually or in combinations thereof which are made by processes such as vulcanization, injection molding, expansion, and extrusion;
4. belted components (also referred to as webbing) generally available in various machine-woven widths and thicknesses and made from assorted natural and man-made fibers and filaments;
5. bands made from natural or man-made filaments that are hand-knitted, crocheted, or woven; and
6. textilized laminates of cork or paper, woven textiles of man-made filaments of polypropylene (PP) or polyethylene (PE), and metal mesh.

Figure 3:
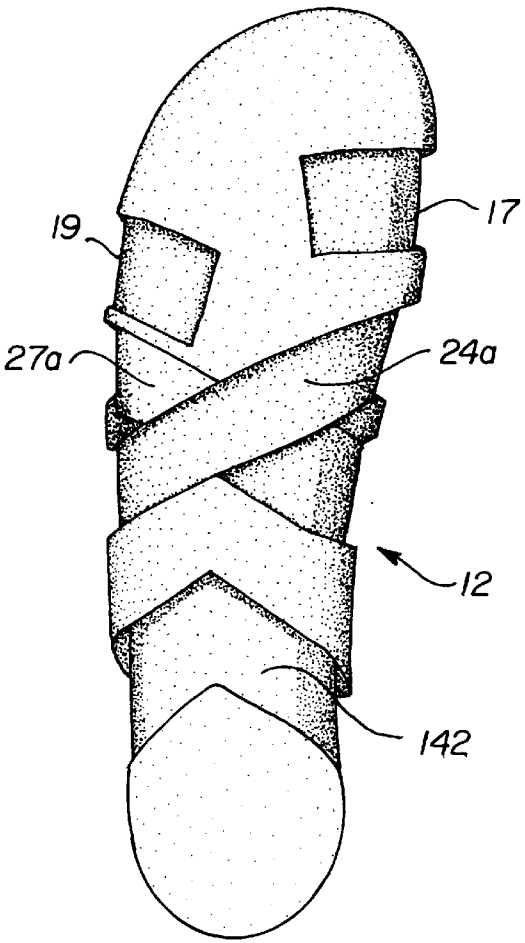
FIG. 3 is a plan view of the bottom of the insole of the sandal of FIG. 1.
Figure 2:
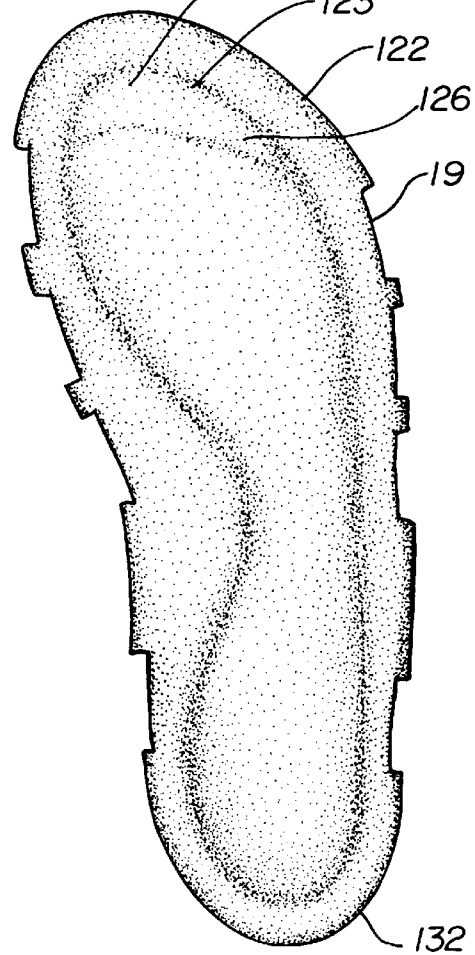
FIG. 2 is a top plan view of the insole of the sandal of FIG. 1.
Figure 5:
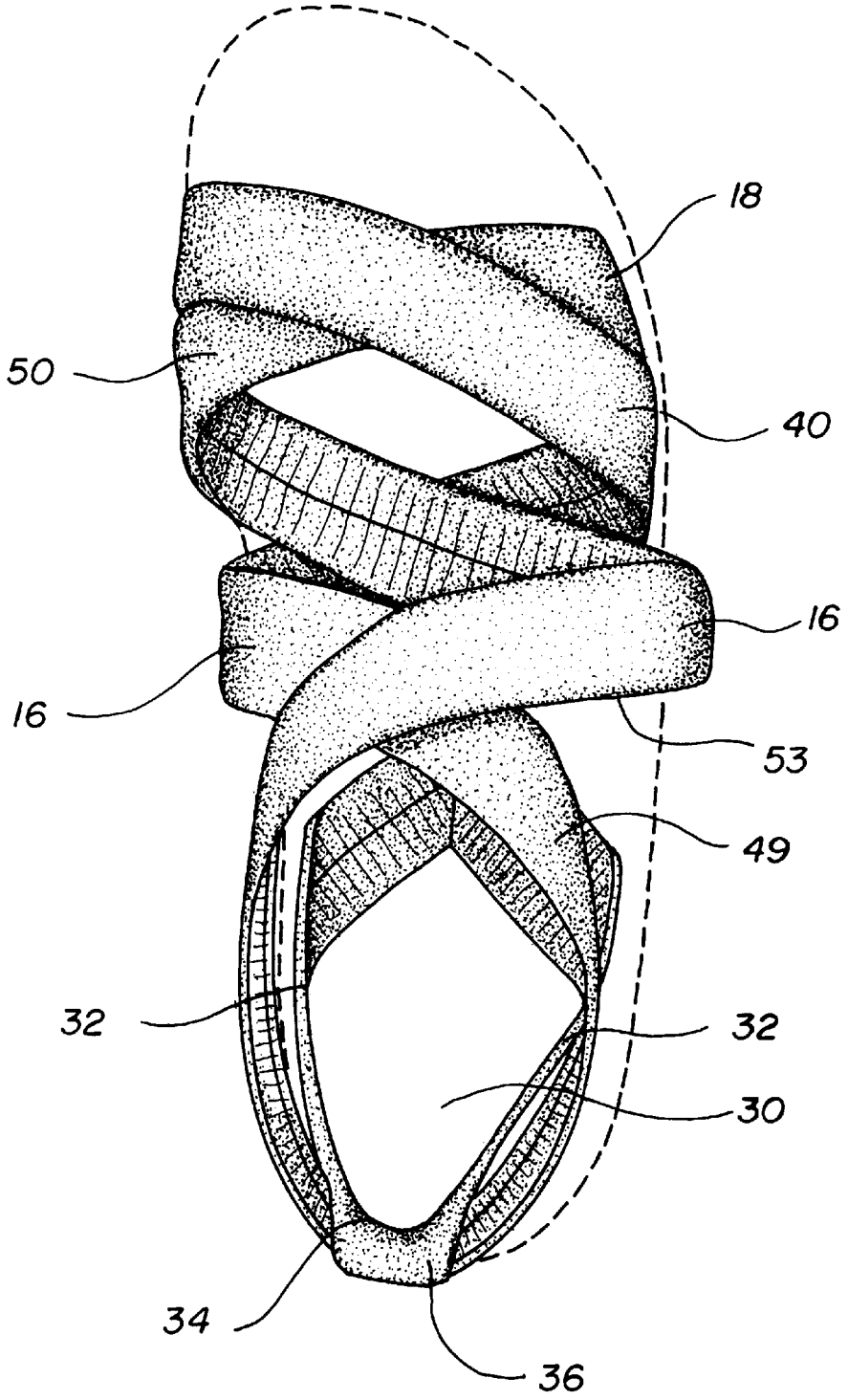
FIG. 5 is a top plan view, partially broken away, of the upper of the sandal of FIG. 1.
Figure 6:
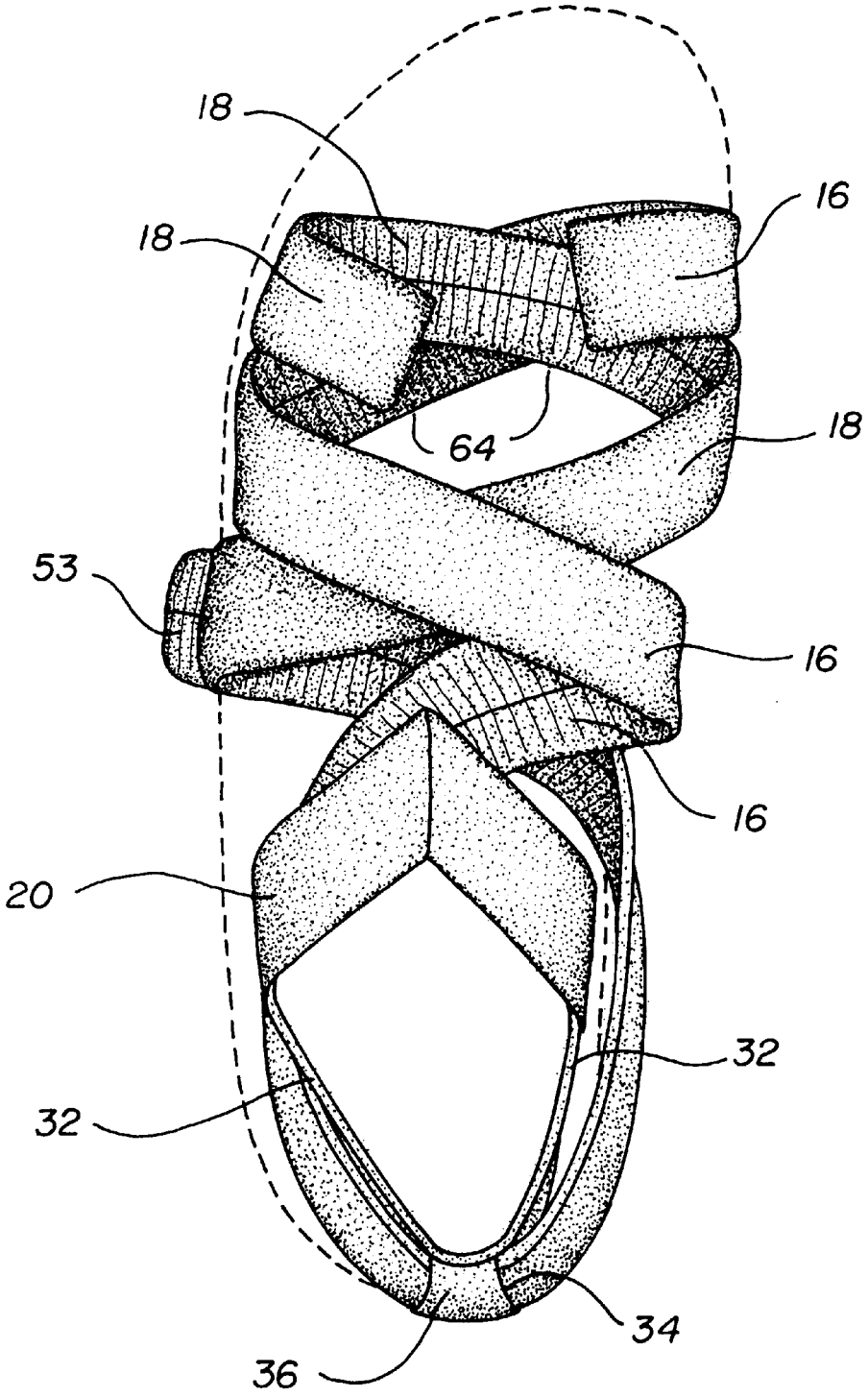
FIG. 6 is a bottom plan view, partially broken away, of the upper of the sandal of FIG. 1.

With reference to FIGS. 2 and 3, the insole 12 preferably is a globally-contoured expansion-molded EVA (ethylvinylacetate) unit of a durometer of about shore 50, the exposed surface of which is covered with leather. Preferably it is anatomically designed, with a forefoot perimeter wall 122, an anatomically correct toe-crest 123, a great toe rest 124, a lesser toes rest 126, a footbed floor 128, an ergonomically engineered arch 130, and a rear enclosure formed by a heel cup wall 132. The lower surface of the insole 12 has functional indentations to accommodate the straps, namely, it includes the short strap lasting-indentation anchor point 19, a short strap pass-through indentation 24*a*, a long strap lasting-indentation anchor point 17, a long strap pass-through indentation 22*a*, and a heel strap indentation 142. The relative depths and widths of the indentations 17, 19, 22*a*, and 24*a* are consistent with the dimensions of the corresponding indentations (as described below) in the outer sole 14. The long strap pass-through indentation 22*a* is complimentary to a corresponding long strap pass-through indentation 22*b* in the outer sole 14 as described below, and accordingly commences at zero depth at the point of intersection with the short pass-through indentation 24*a*, and gradually increases to a depth equal to the thickness of the long strap 16 at the lateral edges of the insole 12.

Figure 4:
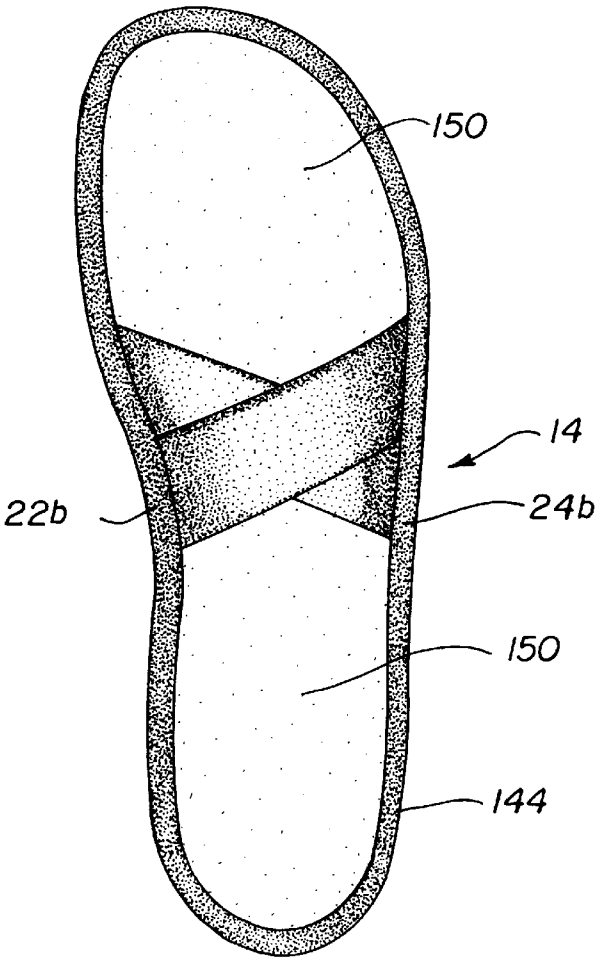
FIG. 4 is a top plan view of the top of the outsole of the sandal of FIG. 1.

With reference to FIG. 4, the outer sole 14 comprises a perimeter wall 144 that actually encases the insole 12, a short strap pass-through indentation 24*b*, a long strap pass-through indentation 22*b* and an insole cavity floor 150. The outer sole long strap pass-through channel 22*b* has a width consistent with the width of the long strap 16, a depth consistent with the thickness of the short strap 18 added at the center of the indentation 22*b*, from where it gradually diminishes to a zero depth as it approaches the perimeter wall 144. The short strap pass-through indentation 24*b* has a width consistent with the width of the short strap 18 and is complimentary to the indentation 24*a* in the insole 12. Thus, the depth of the indentation 24*b* is substantially zero. The indentation 24*b* intersects the long strap pass-through indentation 22*b* and continues to the perimeter wall 144, at both sides. The floor 150 of the outer sole 14 optionally can include weight relief cavities.

The insole 12 can be formed from a variety of materials and methods including the aforementioned EVA, covered with leather, or optionally any of the following methods with the following materials:

1. partially or completely covering the exposed surfaces of a formed component with a non-leather material (such as those described above as substitute upper components), optionally utilizing finishes applied by spray, dipping, or hand-painting processes;
2. using a formed component with no form of sealing or closure;
3. utilizing cork and latex hybrids, wood, PU, TPR, or PVC; and
4. utilizing vulcanization, lathe-turning, 3D milling, expansion molding, or injection molding.

Similarly, the outer sole 14 can be made from a variety of materials such as polyurethane, EVA, latex, polyvinyl chloride, and mixtures thereof. It can be formed by a variety of processes such as expansion molding, injection molding, and vulcanization.

Assembly of the sandal 10 commences with optionally cementing a soft leather sock-lining to the insole 12. Then straps 16 and 18 are conventionally lasted at anchor points 17 and 19, respectively. The ankle strap 20 is closed with a zig-zag stitch, and then lasted at the 142. Prior to further assembly, preferably the indentations 22*a*, 22*b*, 24*a*, and 24*b* are treated with a suitable long-life dry lubricant.

A last is then introduced facilitating completion of the upper. The short strap 18 is passed over the toes in an external to medial direction. Upon encountering the medial side of the insole 12, the short strap 18 is placed in the short strap indentation 24*a* where it crosses in a medial to external direction. Upon exiting the indentation 24*a*, the short strap 18 is temporarily secured to the last, awaiting closure with the long strap 16.

The long strap 16 is passed over the toes, passing over the short strap 18, in a medial to external direction. Upon reaching the external side of the insole 12, the long strap 16 is nested in pass-through indentation 22*a*, passing over the short strap 18, crossing in an external to medial direction. Upon exiting the indentation 22*a* on the medial side, the long strap 16 rises vertically to cross instep portion, in a medial to external direction. Upon cresting the instep the course of the long strap 16 is naturally altered by the incline of the cone of the last corresponding to the instep of the foot in relation to the angle of ascent of the long strap 16. Hence, the long strap 16 continues in a rearward direction until it encounters the ankle strap 20 passing through halter channel 36, and continues around the ankle on the medial side on a forward course, where it intersects and passes over itself and encounters the end of the short strap 18, to which it is fastened.

Figure 8A:
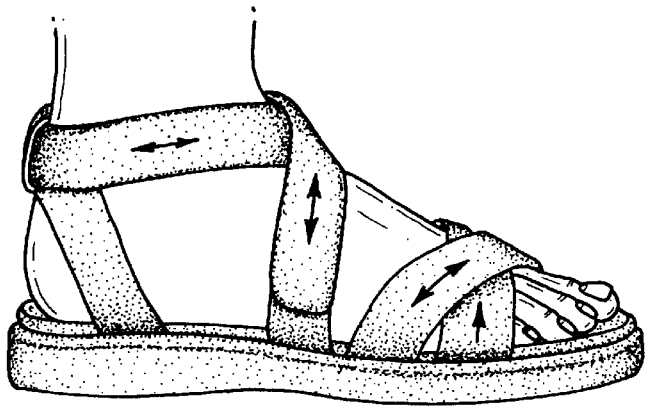
FIG. 8A is a side view of the sandal of FIG. 1 on a wearer's foot on level ground.
Figure 8B:
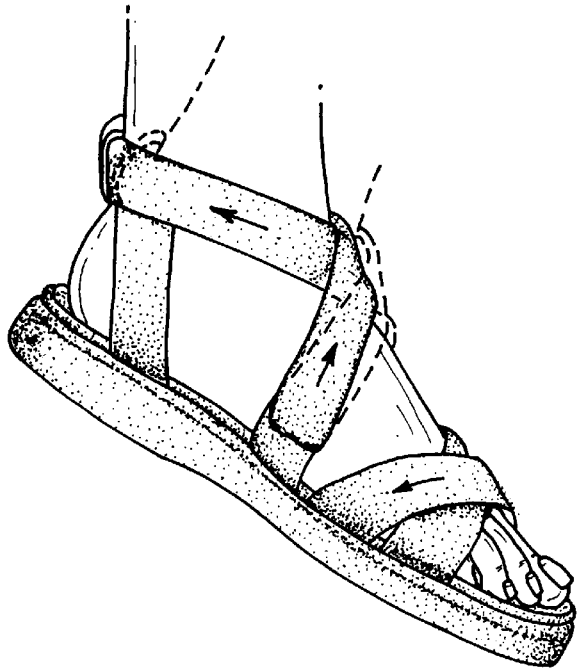
FIG. 8B is a side view of the sandal of FIG. 1 on a wearer's foot on a downslope.
Figure 8C:
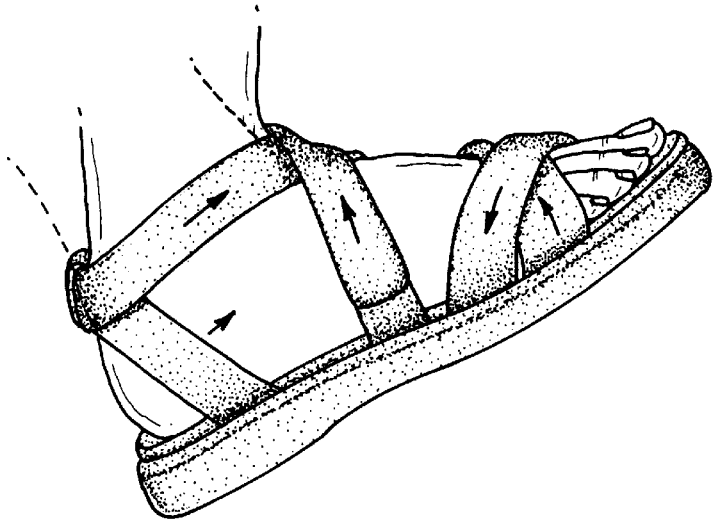
FIG. 8C is a side view of the sandal of FIG. 1 on a wearer's foot on an upslope.

Referring to FIGS. 8A–8C, advantages of the present invention are evident. The sandal 10 can be cinched up and fastened over the entire foot in one simple fastening operation. There is no need for a multitude of gaudy or unsightly buckles to mar the appearance of the sandal 10. As shown in FIG. 8B, when walking downhill, the ankle strap 20 is pulled rearward to continue to hold the wearer's foot. Moreover, as shown in FIG. 8C, when a wearer walks uphill, the heel strap 20 retains the wearer's heel from slipping to the rear and is not loosened when the wearer's foot presses backwards, which in the prior art is translated to slack in the heel region.

The long strap 16 and the short strap 18 effectively form a single strap unit that wraps about the wearer's foot and is securely anchored both beneath the front of the foot at the anchor points 17 and 1 9 and behind the foot at halter channel 36, and securely, slidably retained by the channels 22 and 24. This construction retains the foot snugly yet comfortably in position on the insole 12.

Because the strap unit is infinitely adjustable, any shape foot can be accommodated. As the wearer walks, if a first portion of the foot requires a bit more room, a second portion of the foot can yield some of the strap unit to accommodate the first portion.

Although the present invention has been described in considerable detail with reference to certain preferred versions thereof, other versions are possible. For example, rather than interconnecting the long strap 16 to the heel strap 20 at the halter channel 36, a separate loop can be attached to the heel strap through which the long strap can extend. Moreover, the sandal need not have a relatively flat bottom. It can be configured with low heels or high heels for fashion purposes. Further, rather than being used with sandals, the present invention can be used in other types of footwear, such as rafting shoes. Moreover, the width of the straps can be made wider or narrower than is shown in the drawings.

Accordingly, the scope of the present invention should not be limited to the description of the preferred versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. Footwear for a wearer having a heel and an ankle, the sandal comprising:

a) a sole having a rear heel portion, a forward portion, and an intermediate portion therebetween; and b) a slippage-resistant heel halter comprising:

i) a heel strap non-adjustably and fixedly secured to the sole at the intermediate portion thereof and extending rearwardly to form a loop for engaging a user's heel;

ii) an ankle strap secured to the sole forward of the rear heel portion, the ankle strap forming an ankle loop for engaging the wearer's ankle; and iii) means for interconnecting the ankle strap to the heel strap where the heel strap engages the wearer's heel.

2. The footwear of claim 1 wherein the ankle strap has opposed first and second end portions, and the footwear has first securing means fixedly securing the first end portion of the ankle strap to the sole and second securing means releaseably securing the second end portion of the ankle strap to the sole.

3. The footwear of claim 1 wherein the second securing means comprises means for adjustably securing the second end of the ankle strap to the sole for varying the size of the ankle strap loop.

4. The footwear of claim 1 wherein the means for interconnecting comprises a channel in the heel strap through which the ankle strap extends.

5. A sandal comprising:

a) a sole having a rear heel portion, a forward portion, and an intermediate portion therebetween, the sole having a first transverse channel through the forward portion;

b) a heel strap non-adjustably and fixedly secured to the sole at the intermediate portion thereof and extending rearwardly to form a loop for engaging a wearer's heel;

c) a main strap having a first portion and a second portion;

d) securing means for securing the first portion of the main strap to the sole, and second securing means for adjustably and releasably securing the second portion of the main strap to the sole to accommodate different sized and shaped feet;

e) wherein the main strap extends through the first transverse channel and forms (i) a forward loop for engaging the forward portion of a wearer's foot, and (ii) an ankle loop for engaging the wearer's ankle; and f) means for interconnecting the ankle loop to the heel strap where the heel strap engages a wearer's heel.

6. The sandal of claim 5 wherein the second securing means comprises a forward strap fixedly secured to the forward portion of the sole, and a fastener for adjustably and releasably fastening the main strap to the forward strap.

7. The sandal of claim 6 wherein the forward strap includes a loop over the forward portion of the sole for engaging the forward portion of a wearer's foot.

8. The sandal of claim 7 wherein the sole comprises a second transverse channel through which the forward strap extends.

9. A method for securing a sandal to the foot of a wearer comprising the steps of:

a) selecting the sandal of claim 6;

b) placing the foot into the sandal with the heel strap loop engaging the wearer's heel, the forward loop engaging the forward portion of the wearer's foot; and c) fastening the main strap to the forward strap so that the ankle loop securely engages the wearer's ankle.

* * * * *